US006183156B1

(12) United States Patent
Morris

(10) Patent No.: US 6,183,156 B1
(45) Date of Patent: Feb. 6, 2001

(54) SPREADER BROOM UNIT FOR APPLICATION OF ROOFING MASTIC

(76) Inventor: Paul L. Morris, 8815 W. 104th St., Overland Park, KS (US) 66212

( * ) Notice: Under 35 U.S.C. 154(b), the term of this patent shall be extended for 0 days.

(21) Appl. No.: 09/415,557

(22) Filed: Oct. 8, 1999

(51) Int. Cl.[7] ..... A46B 11/04

(52) U.S. Cl. ..... 401/282; 401/48; 401/285; 401/289

(58) Field of Search ..... 401/282, 283, 401/284, 285, 289, 137, 194, 268, 48, 1

(56) References Cited

U.S. PATENT DOCUMENTS

| | | | | |
|---|---|---|---|---|
| 1,093,532 | * | 4/1914 | Cavalier | 401/137 |
| 3,110,055 | * | 11/1963 | Merrill | 401/137 |
| 3,134,129 | * | 5/1964 | Allen | 401/284 |
| 3,751,747 | * | 8/1973 | Blaeldh | 401/137 |
| 4,265,559 | * | 5/1981 | Mellen | 401/48 |
| 5,050,530 | * | 9/1991 | Studebaker et al. | 401/137 |
| 5,211,158 | | 5/1993 | Morris . | |
| 5,353,782 | | 10/1994 | Morris . | |
| 5,358,347 | | 10/1994 | Morris . | |
| 5,419,647 | | 5/1995 | Kirk et al. . | |
| 5,540,022 | | 7/1996 | Morris . | |
| 5,552,014 | | 9/1996 | Morris . | |
| 5,600,929 | | 2/1997 | Morris . | |
| 5,622,023 | * | 4/1997 | Crispino | 401/48 |
| 5,776,299 | | 7/1998 | Morris . | |

* cited by examiner

*Primary Examiner*—David J. Walczak
(74) *Attorney, Agent, or Firm*—Hovey, Williams, Timmons & Collins

(57) ABSTRACT

Apparatus (10) for the application and even spreading of flowable roofing materials such as bituminous mastics which includes an elongated, hollow delivery bar (14) adapted to be pulled across a roofing surface and having a plurality of material delivery openings (40) along the underside thereof, as well as a material spreader (16) positioned adjacent the bar (14). The spreader (16) includes first and second elongated, generally side-by-side brooms (42, 44) in trailing relationship to the bar (14). The first broom (42) is generally concave, whereas the second broom (42) is substantially rectilinear). A tubular handle (32) is coupled with the bar (14) for delivery of heated material thereto. A temperature gauge (36) is mounted on the handle (32) in close adjacency to the bar (14), allowing the user to closely monitor material temperatures at the point of application. An alternate delivery bar **(14*a*) has individual nipple-valves (82)** affording better material flow control.

18 Claims, 2 Drawing Sheets

26a
14a
86
27
88
82

46
16
48
42
38
14
66
44
12
22
70
18
62
50
10
24
52

78a
34
58
3.
32
66
78
3.
78a
80
60
18
64
72
32
20
68
34
36
66
24
14a
22
26
86
38
84
40a 18
82
46
48

SPREADER BROOM UNIT FOR APPLICATION OF ROOFING MASTIC

BACKGROUND OF THE INVENTION

1. Field of the Invention

The present invention is broadly concerned with an improved applicator/spreader apparatus useful in roofing operations for the spreading of viscous flowable materials such as asphaltic roofing mastics. More particularly, the invention pertains to applicator/spreader devices which employ a delivery bar with a pair of specially configured trailing brooms serving to spread and evenly apply roofing materials. The devices of the invention further preferably include a temperature gauge located in close adjacency to the delivery bar so as to allow the user to exercise a greater and more accurate degree of control for application and spreading operations.

2. Description of the Prior Art

Many industrial-type buildings constructed during the last 30 to 40 years were roofed with metallic decking panels. Such panels were normally secured by screws, bolts, or rivets penetrating the metal decking, these penetrations being sealed. Metal roofs of this type suffer from a number of disadvantages, including a tendency to leak, and poor thermal insulation qualities. Over the years, as these metal roofs have begun to wear out, the building owners are faced with the task of providing a replacement roof. Generally speaking, it is a very expensive proposition to remove the original metal decking, and replace it with new decking. Another alternative is to simply place a new metal deck atop the original deck. This is a problem inasmuch as the new metal roof imposes a significant dead load upon the structure of the building, which is particularly troublesome in the case of older buildings.

It has also been suggested in the past to provide a replacement built-up roof using the worn metal roof as a substrate. In such systems, preformed panels of expanded polystyrene, adapted to be placed over the contour of the original deck are employed. Such panels have rigid boards secured to the upper surfaces thereof, and are generally provided in 4'×4' or 4'×8' sections. With such built-up roofs, hot asphalt is initially applied to the decking, whereupon the preformed insulation panels are applied. At this point, a roofing membrane may be secured to the upper surface of the foam panels sections, followed by conventional lap joint sealing and finishing. In some of these prior built-up constructions, hot asphalt or existing mastics have been employed which include asphalt, mineral spirits, fibers and fillers. A problem with these roofs is that, in the event of a fire, the polystyrene foam readily melts and becomes flowable, and then drips into the building below with the asphalt. This can cause severe damage to the building and its contents, and indeed the fire insurance rates for a building having a built-up roof of this character are increased because of this hazard if insurable at all.

U.S. Pat. No. 5,358,347 describes a greatly improved built-up roofing system which overcomes many of the problems with prior replacement roofs. As an adjunct to the roofing system, the '347 patent also discloses an improved applicator apparatus for the application and spreading of roof mastics. This applicator employs an elongated, transversely extending delivery bar having a series of valve units along the length thereof, with trailing spreader chains designed to spread and apply mastic delivered from the bar. While applicator devices as shown in the '347 patent represent a distinct improvement in the art, it has been found that the use of trailing spreader chains can sometimes fail to give complete and uniform coverage on a roofing deck.

There is accordingly a need in the art for an improved applicator/spreader device especially designed for roofing operations and which serves to evenly apply and spread viscous roofing materials over a variety of deck surfaces.

SUMMARY OF THE INVENTION

The present invention overcomes the problems outlined above, and provides an improved apparatus for the application and spreading of flowable roofing materials. Broadly speaking, the apparatus includes an elongated, hollow, apertured delivery bar adapted to be pulled across a roofing surface, with a trailing material spreader adjacent the bar; the spreader comprises first and second elongated, generally side-by-side brooms oriented for engaging and spreading the roofing material. In addition, the preferred apparatus includes a temperature gauge located in close proximity to the spreader bar (and preferably within three feet thereof) to monitor the temperature of the roofing material substantially at the point of application thereof.

In more detail, the apparatus of the invention advantageously includes a spreader bar made up of an initial manifold in communication with a delivery conduit; the latter has a series of laterally spaced apart outlet openings through the bottom wall thereof. A tubular delivery handle is affixed to the manifold and extends upwardly to allow manual manipulation of the apparatus. The upper end of the tubular handle is adapted to be coupled to a flexible hose or other source of flowable material. In alternative forms, respective valve members are associated with each of the outlet openings of the delivery bar, where each valve member includes an elongated, tubular metallic outlet surrounded by a flexible nipple-type cover.

The dual-broom material spreader preferably includes a first broom located adjacent and in trailing relationship to the delivery bar which has a somewhat concave configuration in plan, presenting a central section and a pair of obliquely oriented side sections. The opposed ends of the first broom are located outboard of the ends of the spreader bar so as to assist in confining flowable material during the application process. A second broom, preferably of substantially rectilinear configuration, is located in trailing relationship to the first broom. The opposed ends of the second broom preferably lie outboard of the ends of the first broom.

DETAILED DESCRIPTION OF THE PREFERRED EMBODIMENT

Figures 1, 5, 6:
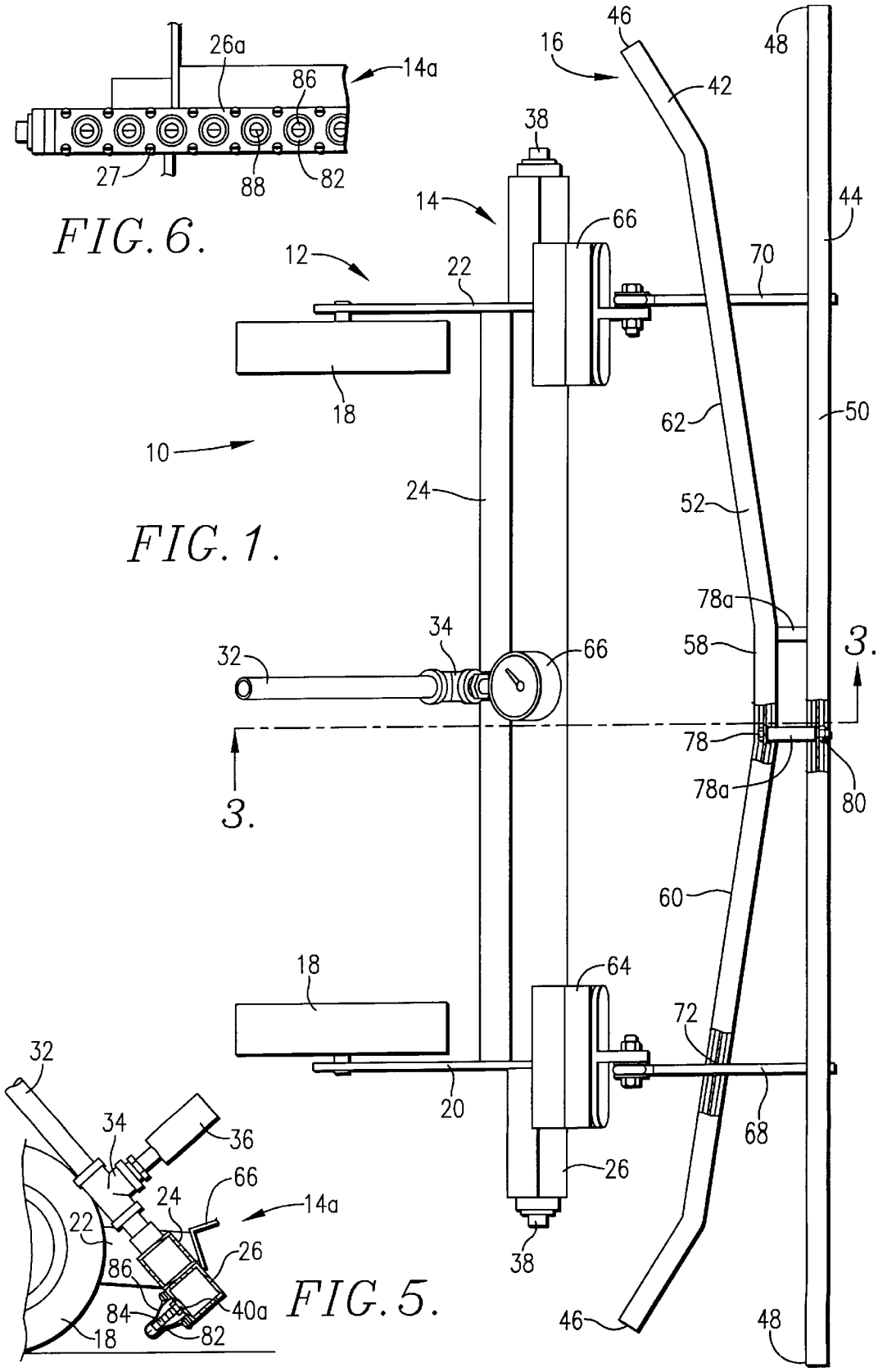
FIG. 1 is a fragmentary top view with parts broken away of the preferred applicator apparatus of the invention.
FIG. 5 is a fragmentary view in partial vertical section illustrating another embodiment of the invention, wherein the output openings of the delivery bar include corresponding nipple-type valve members.
FIG. 6 is a fragmentary bottom view depicting the construction of the delivery bar of the embodiment of FIG. 5.
Figure 3:
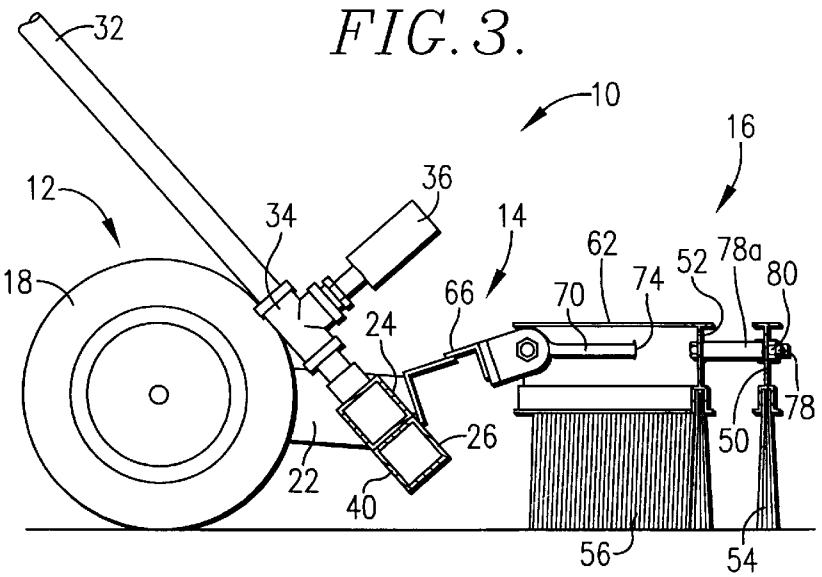
FIG. 3 is a vertical sectional view taken along line 3—3 of FIG. 1.
Figure 2:
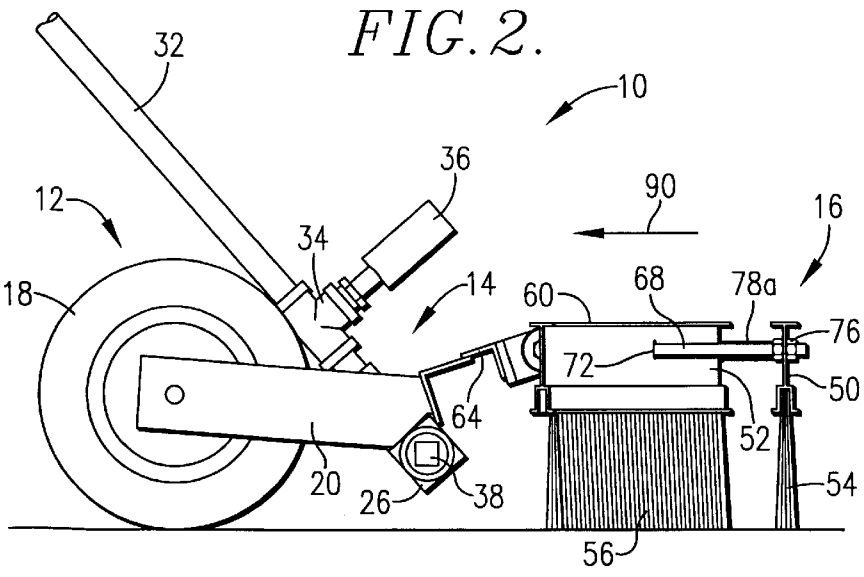
FIG. 2 is a side view of the apparatus.

Turning now to the drawings, and particularly FIGS. 1–3, an apparatus 10 for the even application and spreading of a flowable roofing material onto a roof deck is illustrated. The apparatus 10 includes a frame 12, an elongated, hollow delivery bar 14 supported by the frame 12, and a material spreader 16 positioned adjacent and rearwardly of the bar 14 in order to evenly spread and apply flowable material delivered from the bar 14.

In more detail, the frame 12 includes a pair of laterally spaced apart wheels 18 and a corresponding pair of elongated frame plates 20, 22 supporting the wheels 18 at the forward ends of the plates; the rearward ends of the plates 20, 22 support the bar 14.

Figure 4:
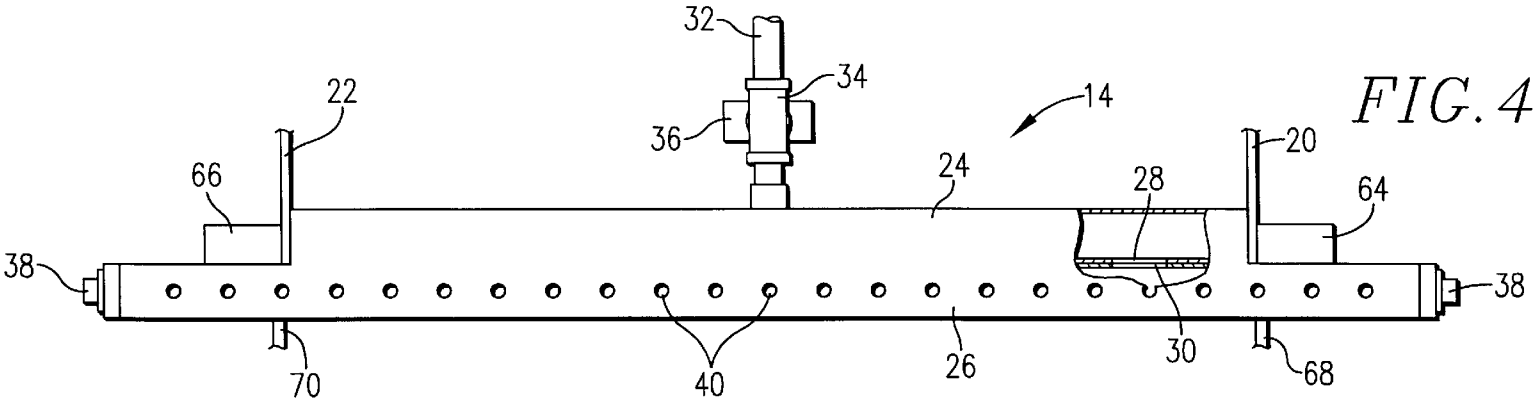
FIG. 4 is a fragmentary bottom view with parts broken away illustrating the construction of the delivery bar of the applicator apparatus.

The delivery bar 14 includes and elongated, laterally extending hollow manifold 24 extending between and connected to the frame plates 20, 22. In addition, the bar 14 has an elongated, laterally extending, hollow delivery conduit 26 welded to the underside of manifold 24. As best seen in FIG. 4, the adjacent, interconnected walls of the manifold 24 and conduit 26 have registered flow apertures 28, 30 therethrough, thereby establishing communication between the manifold 24 and conduit 26.

An elongated, tubular, generally centrally located and forwardly extending handle 32 is affixed to the upper wall of manifold 24 so as to communicate the interior of the handle 32 with the manifold interior. The handle 32 is adapted to be manually grasped by a user so as to pull the apparatus 10 during operation as will be described. As will be readily understood, the upper end (not shown) of the handle 32 is adapted for connection to a flexible tube or other source of flowable material. In addition, in preferred forms, a tee 34 is provided in the handle 32 adjacent manifold 24. A temperature gauge 36 is secured to the tee 34 as shown so as to permit measurement and monitoring of the temperature of flowable material as it is delivered to the bar 14.

The conduit 26 is somewhat longer than manifold 24 and is provided with a pair of removable, threaded end caps 38. In addition, the bottom wall of conduit 26 is provided with a series of laterally spaced apart openings 40 therethrough, as best seen in FIG. 4.

The spreader 16 is positioned adjacent bar 14 and is spaced rearwardly therefrom. The spreader includes first and second brooms 42, 44 presenting end margins 46 and 48. Referring to FIGS. 2 and 3, it will be observed that the brooms 42, 44 each includes an elongated, upstanding bristle holder 50, 52 supporting a series of depending bristles 54, 56. The rearmost second broom 44 is essentially rectilinear in plan configuration, whereas the first broom 42 is specially configured to present a central portion 58 as well as lateral wing or side portions 60,62 which extend obliquely towards bar 14. It will be observed that the ends 46 of first broom 42 lie inboard of the ends 48 of the second broom 44; moreover, both of the brooms 42, 44 are of length greater than that of the bar 14 such that the ends 46 of broom 42 and the ends 48 of broom 44 lie outboard of the ends of the bar 14.

The brooms 42, 44 are supported in trailing relationship relative to the bar 14 by means of a pair of brackets 64, 66 (FIG. 1) each having a forwardly extending connection rod 68, 70 secured thereto. The rods 68, 70 pass through openings 72, 74 provided in bristle holder 52, and through similar openings provided through bristle holder 50. As best seen in FIGS. 2–3, nuts 76 are employed to secure the outer ends of the pins 68, 70 to bristle holder 50. In order to provide additional support, a pair of short bolts 78 extend from the central portion 58 of first broom bristle holder 52 to the second broom bristle holder 50. Endmost nuts 80 complete this connection. In addition, the stretches of the bolts 78 between the holders 52, 50 are covered by tubular covers 78*a*.

Referring to FIGS. 5–6, an alternative embodiment is illustrated with a delivery bar 14*a* having a valve 82 associated with each of the delivery openings 40*a* thereof. These valves are similar to those described in U.S. Pat. No. 5,358,347 which is incorporated by reference herein. Each such valve 82 includes an elongated tubular metallic outlet 84 secured to the conduit 26 in registry with an associated opening 40*a*. The outlets 84 each have a flexible nipple 86 in surrounding relationship thereto, with each such nipple 86 having a central slit-type opening 88 formed in the outer end thereof (see FIG. 6). In order to facilitate clean-out of the valves, the bottom plate 26*a* (FIG. 6) of conduit 26 is removably affixed by screws 27, thereby allowing removal of the bottom plate for valve clean-out purposes. In all other respects, the delivery bar 14*a* of the FIGS. 5–6 embodiment is identical with that described previously.

In the use of the applicator/spreader apparatus 10 of the invention, a tube or other supply of flowable material (e.g., modified bitumen or other bitumen-based material) is affixed to the upper end of handle 32. Normally this material is delivered to the apparatus 10 in a heated condition and under pressure. As the material flows through the handle 32 it first passes into manifold 24 and thence into the delivery conduit 26 for ultimate passage through the outlet openings 40; in the case of the FIGS. 5–6 embodiment, the material flows through the respective valves 82 associated with each of the openings. During material flow, the user pulls apparatus 10 in the direction shown by arrow 90 of FIG. 2, so that the spreader 16 trails delivery bar 14 to thus effect spreading and even application of the material. In this regard, the first broom 42, because of its somewhat concave shape in plan, serves to collect and inhibit flow of material past the ends 46. Furthermore, the follow-up second broom 44 efficiently spreads flowable material as it passes through and around the bristles 56 of first broom 42. It has been found that the use of a dual broom arrangement provides a much improved application of material.

It has also been found that the provision of temperature gauge 36 gives important advantages. That is, it is typical in roofing operations to measure temperature conditions at the material source, generally a heated container or the bituminous material. However, owing to the long conduit length between the material source and apparatus 10, there is often a significant temperature drop at the point of material application. Therefore, the user is generally unaware of the actual temperature conditions at the application site. In order to provide full and even flow through the apparatus 10, it is important to know localized temperature conditions therein, and the gauge 36 serves this purpose.

I claim:

1. Apparatus for evenly spreading a flowable roofing material, comprising:

an elongated, hollow delivery bar adapted to be pulled across a roofing surface and having a pair of opposed ends and a plurality of material delivery openings therethrough along the length of the bar, there being a valve member operably coupled with at least certain of said material delivery openings for selectively permitting flow of material therefrom; and a material spreader positioned adjacent said bar for spreading material delivered through said bar openings, said spreader comprising first and second elongated, generally side-by-side brooms oriented for engaging and spreading said material.

2. The apparatus of claim 1, each of said valve members comprising an elongated, resilient nipple operatively secured to said bar and in communication with a corresponding opening.

3. The apparatus of claim 2, each of said valve members further including an elongated, tubular outlet secured to said bar in registry with said corresponding opening, said outlet being disposed within the confines of said nipple.

4. The apparatus of claim 1, said first and second brooms each presenting a pair of opposed ends, said first broom being located adjacent said bar with the ends thereof located inboard of the ends of said second broom.

5. The apparatus of claim 1, said first broom being located adjacent said bar and having a central portion and a pair of side portions, said side portions extending from said central portion in a direction towards said bar.

6. The apparatus of claim 5, said first broom presenting a pair of ends, said ends being located outboard of said ends of said bar.

7. The apparatus of claim 5, said second broom being essentially rectilinear.

8. The apparatus of claim 1, including a bracket assembly secured to said bar for supporting said first and second brooms.

9. The apparatus of claim 1, including a wheeled frame operatively coupled to and supporting said bar, there being a bracket assembly secured to said bar for supporting said first and second brooms.

10. The apparatus of claim 1, including a temperature gauge located proximal to said bar for measuring the temperature of said flowable material.

11. The apparatus of claim 1, including an elongated, tubular handle secured to said bar and communicating with the interior thereof, the end of said handle remote from said bar being adapted for connection with a source of said flowable material.

12. Apparatus for evenly spreading a flowable roofing material, comprising:

an elongated, hollow delivery bar adapted to be pulled across a roofing surface and having a pair of opposed ends and a plurality of material delivery openings therethrough along the length of the bar; and a material spreader positioned adjacent said bar for spreading material delivered through said bar openings, said spreader comprising first and second elongated, generally side-by-side brooms oriented for engaging and spreading said material, said first and second brooms each presenting a pair of opposed ends, said first broom being located adjacent said bar with the ends thereof located inboard of the ends of said second broom.

13. The apparatus of claim 12, said first broom being located adjacent said bar and having a central portion and a pair of side portions, said side portions extending from said central portion in a direction towards said bar.

14. Apparatus for evenly spreading a flowable roofing material, comprising:

an elongated, hollow delivery bar presenting a leading margin and a trailing margin and adapted to be pulled across a roofing surface and having a pair of opposed ends and a plurality of material delivery openings therethrough along the length of the bar; and a material spreader positioned adjacent said bar for spreading material delivered through said bar openings, said spreader comprising first and second elongated, generally side-by-side brooms oriented for engaging and spreading said material, both of said brooms located in trailing relationship to said trailing margin of said delivery bar whereby both of said brooms engage and spread material delivered from the bar during pulling of the bar across said roofing surface, at least one of said brooms presenting a pair of broom ends, said broom ends being located outboard of said ends of said bar.

15. The apparatus of claim 14, said one broom being said second broom, said first broom being located adjacent said bar.

16. The apparatus of claim 15, said first broom having a central portion and a pair of side portions, said side portions extending from said central portion in a direction towards said bar.

17. Apparatus for evenly spreading a flowable roofing material, comprising:

an elongated, hollow delivery bar adapted to be pulled across a roofing surface and having a pair of opposed ends and a plurality of material delivery openings therethrough along the length of the bar; and a material spreader positioned adjacent said bar for spreading material delivered through said bar openings, said spreader comprising first and second elongated, generally side-by-side brooms oriented for engaging and spreading said material, at least one of said brooms having an elongated, rigid central portion presenting a central portion longitudinal axis and a pair of elongated, rigid side portions presenting respective side portion longitudinal axes, said side portions extending from said central portion in a direction towards said bar with the respective side portion longitudinal axes being oriented at an oblique angle relative to the central portion longitudinal axis whereby the one broom presents a generally concave configuration in plan.

18. The apparatus of claim 17, said one broom being adjacent said bar.

* * * * *